US011731858B2

(12) United States Patent
Aldana et al.

(10) Patent No.: US 11,731,858 B2
(45) Date of Patent: Aug. 22, 2023

(54) ELEVATOR DOOR ROLLER AND TRACK REPLACEMENT

(71) Applicant: G.A.L. Manufacturing Company, LLC, Bronx, NY (US)

(72) Inventors: Bismark J. Aldana, Stamford, CT (US); Andrew Goodwin, New York, NY (US); Charles Mackenzie-Smith, New York, NY (US)

(73) Assignee: G.A.L. Manufacturing Company, LLC, Bronx, NY (US)

( * ) Notice: Subject to any disclaimer, the term of this patent is extended or adjusted under 35 U.S.C. 154(b) by 0 days.

(21) Appl. No.: 18/149,377

(22) Filed: Jan. 3, 2023

(65) Prior Publication Data

US 2023/0136099 A1 May 4, 2023

Related U.S. Application Data

(62) Division of application No. 16/943,530, filed on Jul. 30, 2020.

(51) Int. Cl.

| | |
|---|---|
| ***B66B 13/08*** | (2006.01) |
| ***B66B 7/12*** | (2006.01) |
| ***B66B 7/04*** | (2006.01) |
| ***B66B 13/30*** | (2006.01) |

(52) U.S. Cl.

CPC ..... *B66B 13/08* (2013.01); *B66B 7/046* (2013.01); *B66B 7/1276* (2013.01); *B66B 13/30* (2013.01)

(58) Field of Classification Search

CPC ..... B66B 13/08; B66B 13/30; B66B 7/046; B66B 7/1276; B66B 19/00

See application file for complete search history.

(56) References Cited

U.S. PATENT DOCUMENTS

| | | | | |
|---|---|---|---|---|
| 2,574,496 | A * | 11/1951 | Pomeroy | E05D 15/063 16/105 |
| 3,105,272 | A * | 10/1963 | Tucker, Jr. | E05D 15/0634 49/411 |
| 3,426,480 | A * | 2/1969 | Dzamba | B66B 13/301 187/334 |
| 3,741,351 | A * | 6/1973 | Suozzo | B66B 13/30 52/30 |
| 4,177,881 | A * | 12/1979 | Kappenhagen | B66B 13/08 187/334 |
| 5,323,876 | A * | 6/1994 | McAllister | B66B 13/08 49/102 |

(Continued)

*Primary Examiner* — Michael A Riegelman

(74) *Attorney, Agent, or Firm* — Lerner David LLP

(57) ABSTRACT

A method for replacing parts of an elevator door assembly including installing a hanger mount in an opening of the elevator door hanger, positioning a roller assembly on one side of the elevator door hanger, the roller assembly being configured to receive an engaging member, positioning a leveling cam on another side of the elevator door hanger, the leveling cam configured for sliding contact with a bearing surface of the hanger mount and having a first surface, a second surface, an opening between the first surface and the second surface, and a third surface for contacting the bearing surface, and inserting the engaging member through an opening of the hanger mount and the opening of the leveling cam, and securing the engaging member within the roller assembly.

7 Claims, 9 Drawing Sheets

(56) References Cited

U.S. PATENT DOCUMENTS

| | | | | |
|---|---|---|---|---|
| 2005/0269038 | A1* | 12/2005 | Murakami | B66B 13/308<br>160/40 |
| 2009/0229184 | A1* | 9/2009 | Hideki | E05D 15/063<br>49/70 |
| 2016/0340153 | A1* | 11/2016 | Reysen | B66B 13/08 |
| 2017/0217732 | A1* | 8/2017 | Kitazawa | B66B 13/20 |
| 2019/0084806 | A1* | 3/2019 | Bosshart | B66B 13/12 |
| 2020/0307957 | A1* | 10/2020 | Kashiwakura | B66B 11/0206 |
| 2022/0033227 | A1* | 2/2022 | Aldana | B66B 19/007 |

* cited by examiner

ELEVATOR DOOR ROLLER AND TRACK REPLACEMENT

CROSS-REFERENCE TO RELATED APPLICATIONS

The present application is a divisional of U.S. patent application Ser. No. 16/943,530, filed on Jul. 30, 2020, the disclosure of which is hereby incorporated herein by reference.

TECHNICAL FIELD

The present disclosure relates to elevators, and to replacing the roller and track assemblies of sliding doors for elevator landings and elevator cars.

BACKGROUND

Elevator systems often use sliding doors to enclose an elevator hoistway and to enclose an elevator car. An illustration of sliding doors enclosing a hoistway is shown in FIG. 1A from the perspective of looking at the hoistway from an elevator landing 10. An illustration of sliding doors enclosing an elevator car is shown in FIG. 1B from the perspective of inside the elevator car. An elevator car may stop at an elevator landing 10, which may be one landing of many landings in a building, and at which people may enter and exit the elevator car. The landing 10 may be separated from the hoistway by two sliding doors 15A and 15B to guard against people or objects falling into the hoistway when the elevator car is not at the landing 10. The doors 15A and 15B may respectively hang from roller pairs 20A and 20B which sit on a track 25, with the roller pairs 20A and 20B and track 25 being positioned at a header 30 of the hoistway. Similarly, as shown in FIG. 1B, an elevator car 40 may be separated from the hoistway by two sliding doors 45A and 45B to guard against people or objects falling into the hoistway when the elevator car is not at the landing 10. The doors 45A and 45B may respectively hang from roller pairs 50A and 50B which sit on a track 55, with the roller pairs 50A and 50B and track 55 being positioned at a header 60 of the car 40. Since the sliding door arrangements for the hoistway doors and the car doors are similar the hoistway doors and car doors and their respective parts will be referred to generically throughout this description, with the understanding that where no distinction is pointed out the description is intended to apply to both types of arrangements.

In many prior elevator door systems the rollers for each sliding door are secured to a respective door hanger which is an integral part of the door. Further, in many prior systems the track position is fixed by the header which is, in turn, an integral part of the landing in the case of hoistway doors and an integral part of the car in the case of car doors. FIGS. 2A to 2C illustrate an existing elevator door arrangement. FIG. 2A shows a door arrangement 70 as viewed from a first side of a door 75. The arrangement includes a door hanger 80, a header 85, and a track 90. FIG. 2B shows the door arrangement 70 of FIG. 2A as viewed from a second side of the door 75 with the header 85 and track 90 hidden. FIG. 2C is a side view of door arrangement 70 as viewed along direction D. As can be seen from FIGS. 2A to 2C, the door hanger 80 is an integral part of door 75, and the track 90 sits on a portion of the header 85. The door hanger 80 has openings 80A for respectively mounting rollers 95 which, in turn, ride on the track 90. Also shown in the figures are support rollers 100 and safety retainers 105. In the arrangement of FIGS. 2A to 2C the header 85 is integral with the landing for which the door is used or with the car for which the door is used.

SUMMARY

It has been recognized that the arrangement of prior elevator door systems makes the systems difficult to service and upgrade. For example, it has been recognized that replacing the rollers and track of prior elevator door systems often requires cutting the door hanger off the door, attaching a new hanger to the door, and removing the header and installing a new header. Such replacement is particularly burdensome in that cutting off the door header usually involves using a blowtorch and removing the header may compromise building structure around the header. Moreover, roller and track replacement is often required by a job specification. For instance, many job specifications require that aluminum rollers and plastic tracks of prior door arrangements be replaced with nylon rollers and steel tracks.

In view of the recognized difficulties with prior elevator door arrangements, the present technology is provided. The presently disclosed technology provides for less burdensome, lower cost replacement of elevator door rollers and tracks.

In accordance with an aspect of the present technology an elevator door subsystem includes a hanger mount having a first side, a second side, and an opening between the first side and second side, the first side having at least a portion configured for arrangement in an opening of an elevator door hanger, and the second side having at least a bearing surface; a leveling cam configured for sliding contact with the bearing surface and having a first surface, a second surface, an opening between the first surface and the second surface, and a third surface for contacting the bearing surface; an engaging member configured for placement in the opening of the hanger mount and the opening of the leveling cam; and a roller assembly for receiving the engaging member, such that when the roller assembly is positioned on one side of the elevator door hanger, the hanger mount is positioned within the opening of the elevator door hanger, and the leveling cam is positioned on another side of the elevator door hanger, the engaging member is receivable by the roller assembly after the engaging member is passed through the opening in the leveling cam, the opening in the hanger mount, and the opening in the door hanger.

In accordance with an aspect of the present technology, a method for replacing parts of an elevator door assembly includes removing rollers from an elevator door hanger of the door assembly; installing a hanger mount in an opening of the elevator door hanger, the hanger mount having a first side, a second side, and an opening between the first side and second side, the first side having at least a portion configured for arrangement in the opening of the elevator door hanger, and the second side having at least a bearing surface; positioning a roller assembly on one side of the elevator door hanger, the roller assembly being configured to receive an engaging member; positioning a leveling cam on another side of the elevator door hanger, the leveling cam configured for sliding contact with the bearing surface and having a first surface, a second surface, an opening between the first surface and the second surface, and a third surface for contacting the bearing surface; and inserting the engaging member through opening of the hanger mount and the opening of the leveling cam, and securing the engaging member within the roller assembly.

In accordance with an aspect of the present technology a kit for replacing parts of an elevator door assembly includes a hanger mount having a first side, a second side, and an opening between the first side and second side, the first side having at least a portion configured for arrangement in an opening of an elevator door hanger, and the second side having at least a bearing surface; a leveling cam configured for sliding contact with the bearing surface and having a first surface, a second surface, an opening between the first surface and the second surface, and a third surface for contacting the bearing surface; an engaging member configured for placement in the opening of the hanger mount and the opening of the leveling cam; and a roller assembly for receiving the engaging member, such that when the roller assembly is positioned on one side of the elevator door hanger, the hanger mount is positioned within the opening of the elevator door hanger, and the leveling cam is positioned on another side of the elevator door hanger, the engaging member is receivable by the roller assembly after the engaging member is passed through the opening in the leveling cam, the opening in the hanger mount, and the opening in the door hanger.

BRIEF DESCRIPTION OF THE DRAWINGS

The foregoing aspects, features and advantages of the present disclosure will be further appreciated when considered with reference to the following description of exemplary embodiments and accompanying drawings, wherein like reference numerals represent like elements. In describing the exemplary embodiments of the present disclosure illustrated in the drawings, specific terminology may be used for the sake of clarity. However, the aspects of the present disclosure are not intended to be limited to the specific terms used.

DETAILED DESCRIPTION

Figure 1A:
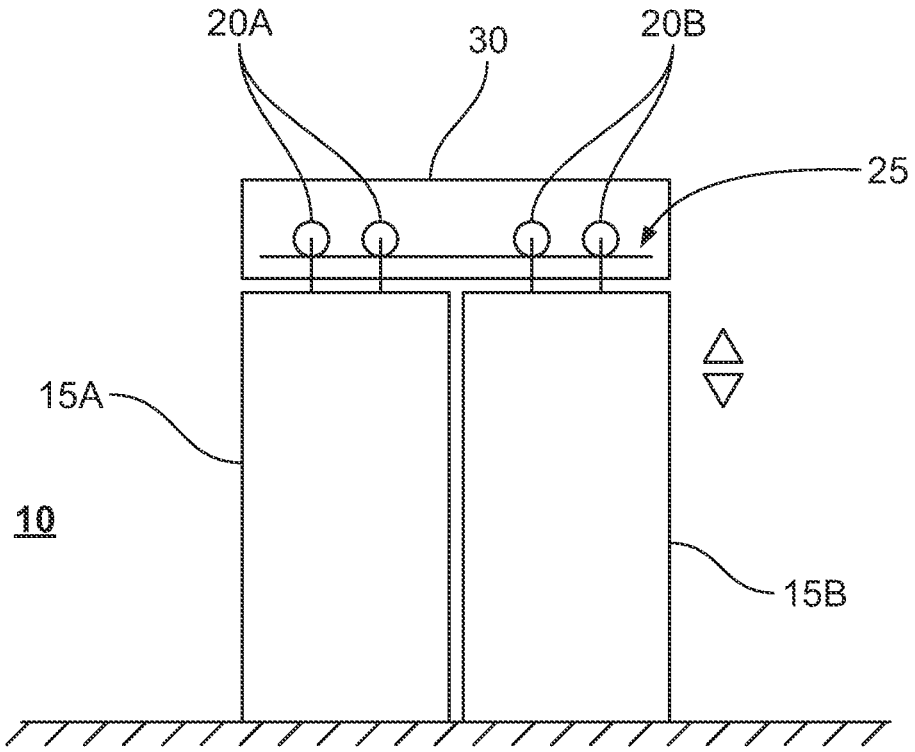
FIG. 1A (Prior Art)
FIG. 1A is a perspective view of sliding doors enclosing an elevator hoistway as seen from the perspective of looking at the hoistway from an elevator landing.
Figure 1B:
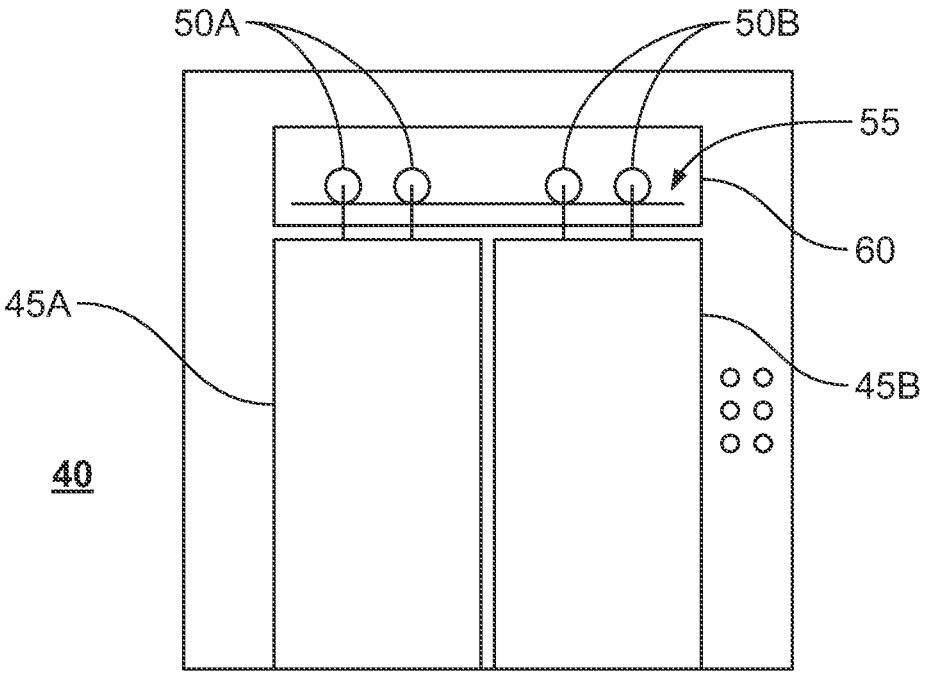
FIG. 1B (Prior Art)
FIG. 1B is a perspective view of sliding doors enclosing an elevator car from the perspective of inside the car.
Figure 2A:
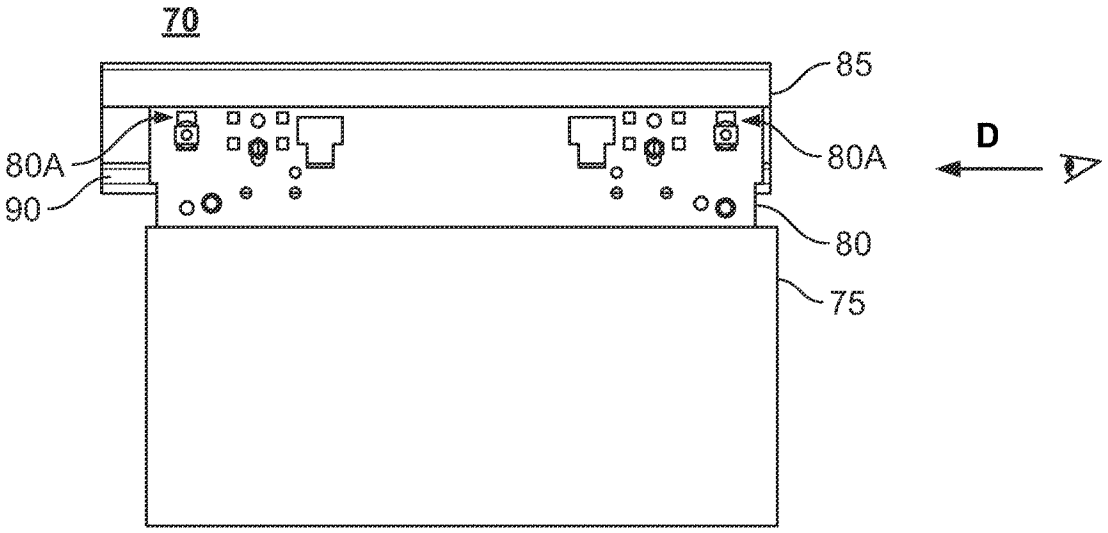
FIG. 2A (Prior Art)
FIGS. 2A-2C depict a prior elevator door arrangement.
Figure 2B:
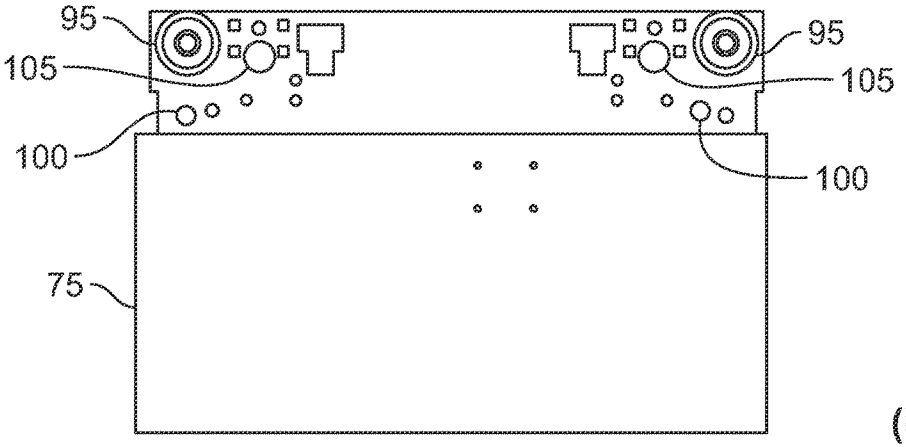
FIG. 2B (Prior Art)
Figure 2C:
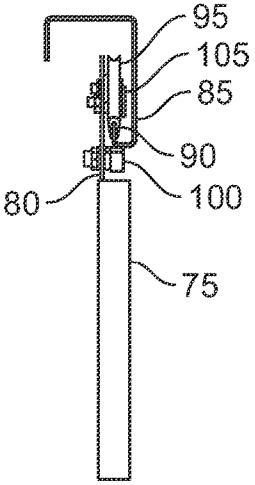
FIG. 2C (Prior Art)
Figure 3A:
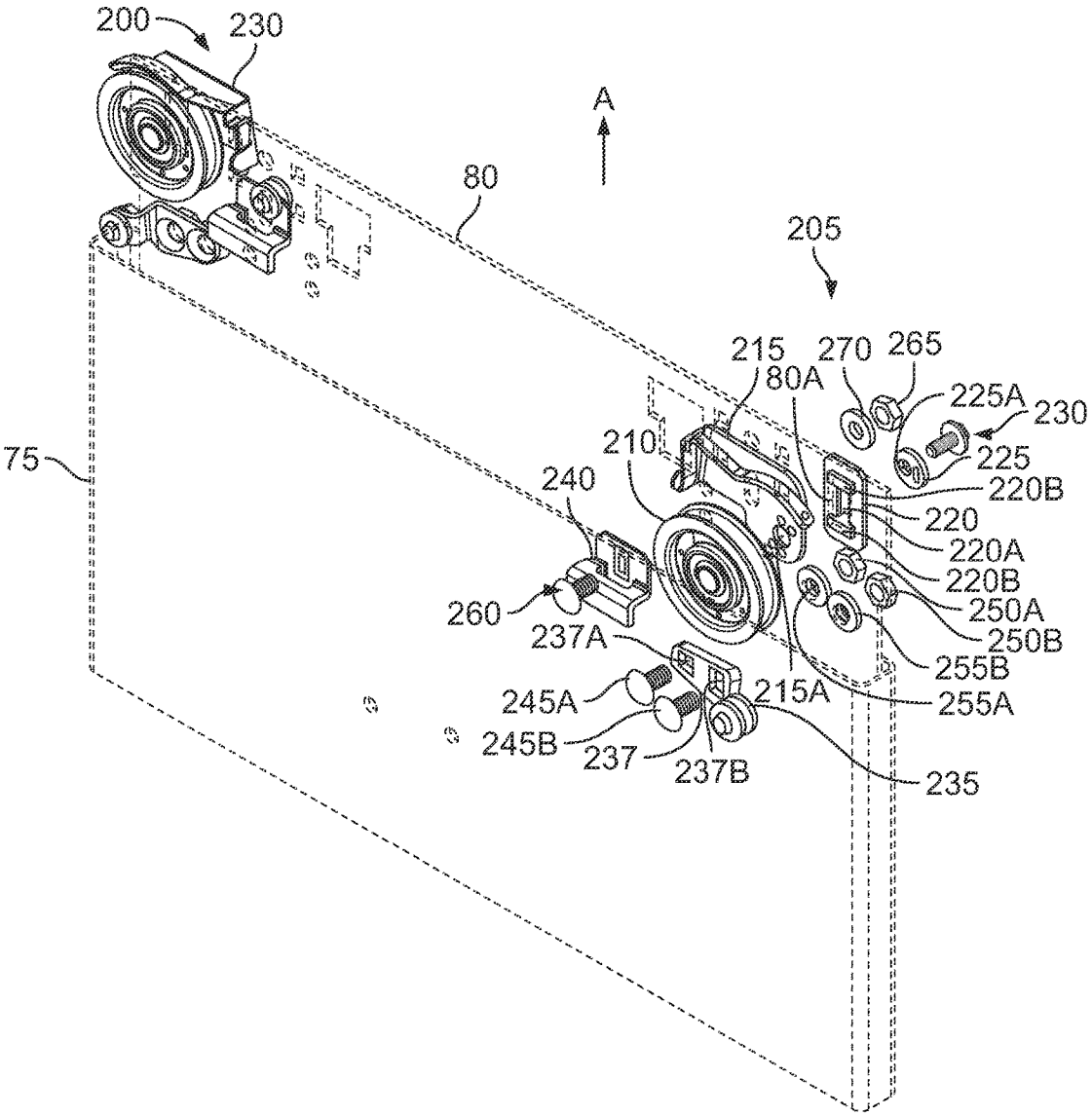
FIG. 3A is an isometric partially-exploded view of an elevator door subsystem for one elevator door according to an embodiment.

FIG. 3A is an isometric partially-exploded view of an elevator door subsystem for one elevator door according to an embodiment. The subsystem of FIG. 3A may be used when replacing the rollers of a prior elevator door. In the depicted embodiment, the subsystem is used for replacing the rollers of the door 75 of FIGS. 2A-2C. The subsystem includes two parts sets 200 and 205, one for each of openings 80A in door hanger 80, although for purposes of brevity of description only set 205 will be described in detail, with any differences between the parts sets also being described.

Parts set 205 includes a roller assembly 210, a cleaner-bracket assembly 215, a hanger mount 220, a leveling cam 225, and an engaging member 230. The roller assembly 210 is typically formed from a multiple of parts, although it may be a single part. The roller assembly 210 may be used to replace, for example, one of the rollers 95 of the FIGS. 2A-2C arrangement, and may include a nylon roller. The cleaner-bracket assembly 215 acts to clean the roller assembly 210 by wiping debris off a roller of the roller assembly 210 as the roller rolls in its associated track (not shown). The roller assembly 210 and cleaner-bracket assembly 215 are secured to door hanger 80 by the hanger mount 220, leveling cam 225, and bolt 230. The hanger mount 220 is shaped to fit into opening 80A in door hanger 80 and includes an opening 220A for allowing bolt 230 to pass through the hanger mount 220. The leveling cam 225 also includes an opening, opening 225A, for allowing bolt 230 to pass through the leveling cam 225. The engaging member 230 may take the form of a bolt or screw, although in view of this description one will readily appreciate the wide range of alternative embodiments for the engaging member. For purposes of conciseness of description, the engaging member is depicted in this description as bolt 230 with the understanding that the engaging member is not limited to a bolt.

In the embodiment of FIG. 3A the hanger mount 220 and leveling cam 225 are placed on one side of the door hanger 80 and the roller assembly 210 and cleaner-bracket assembly 215 are placed on the other side of the door hanger. A portion of the hanger mount 220, in the form of two protrusions 220B, is inserted into opening 80A of the door hanger 80. In the FIG. 3A embodiment the protrusions 220B are rectangular protrusions, although it should be noted that the protrusions may take other forms, such as semi-circular protrusions. In any event, leveling cam 225 is placed against the hanger mount and bolt 230 is passed through the opening 225A in the leveling cam 225 and the opening 220A in the hanger mount, and in such manner passes to the side of the door hanger 80 where roller assembly 210 and cleaner-bracket assembly 215 are positioned. Having been positioned through the leveling cam 225 and hanger mount 220, the bolt 230 is received in an opening in the roller assembly 210, which is in turn fit within an opening 215A in the cleaner-bracket assembly 215. In the embodiment of FIG. 3A the opening in the roller assembly 210 is a blind hole and is not shown in the figure. In any event, the opening in the roller assembly 210 may be threaded to receive corresponding threads of bolt 230. In such a case, when bolt 230 is tightened into the opening in the roller assembly 210 the leveling cam 225 is urged toward the door hanger 80 by the bolt 230 and against the hanger mount 220. Further, when bolt 230 is tightened into the opening in the roller assembly 210 the cleaner-bracket assembly 215 is urged toward the door hanger 80 by the roller assembly 210 and against the hanger mount 220 and door hanger 80. In this manner the roller assembly 210, cleaner-bracket assembly 215, hanger mount 220, and leveling cam 225 are secured to the existing door hanger of FIGS. 2A-2C by way of existing opening 80A.

Figure 3B:
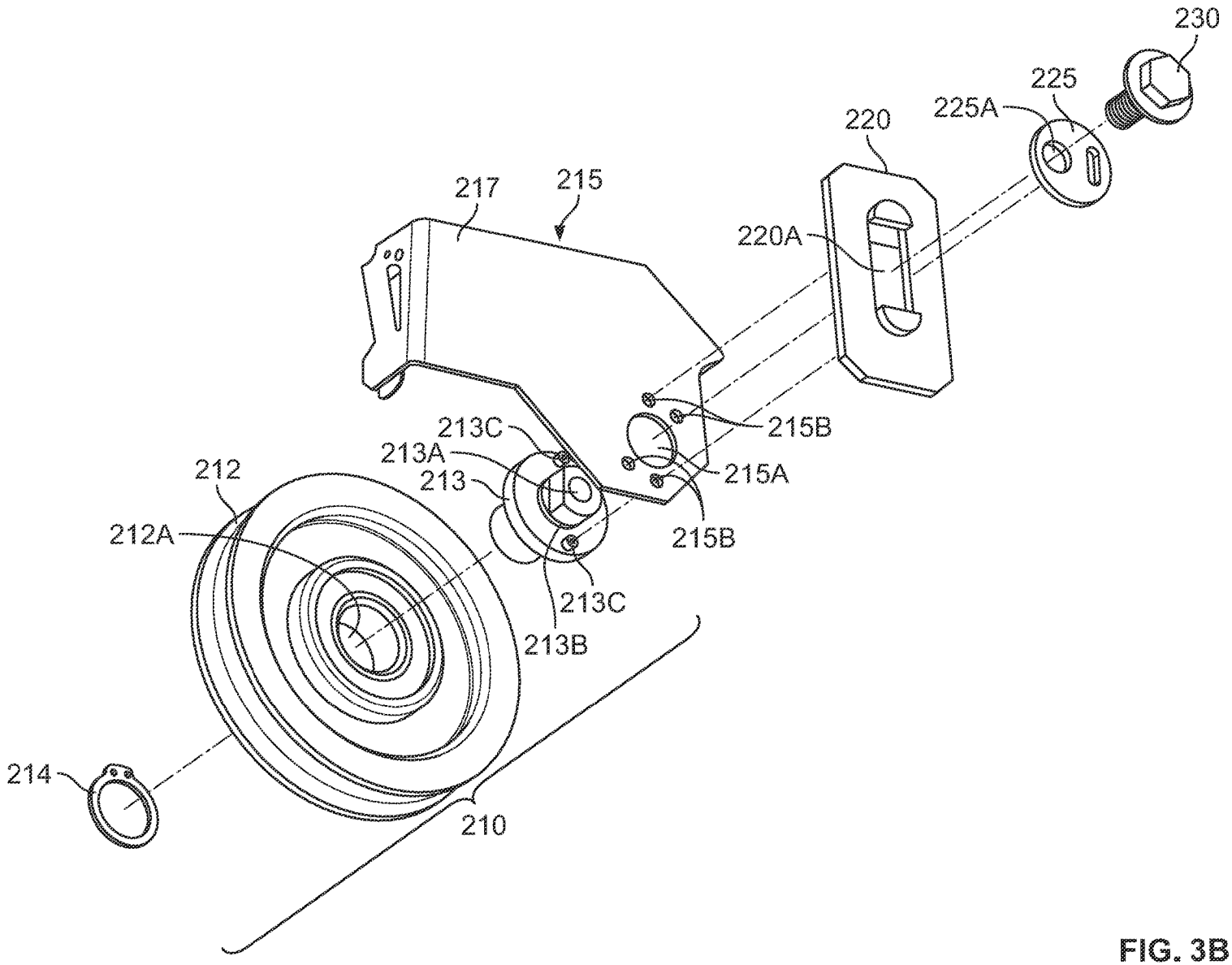
FIG. 3B is an exploded perspective view of a portion of the subsystem shown in FIG. 3A as seen from a first vantage point.

FIG. 3B is an exploded perspective view of the FIG. 3A arrangement of the roller assembly 210, cleaner-bracket assembly 215, hanger mount 220, leveling cam 225, and bolt 230. As can be seen from FIG. 3B, the roller assembly 210 may be formed of three parts, a roller 212, a shaft 213, and a retaining clip 214. The roller 212, e.g., a nylon roller, includes an opening 212A for receiving the shaft 213. The shaft 213 includes an opening 213A, e.g., a blind-hole, for receiving bolt 230. The retaining ring 214 couples to the shaft 213 so as to maintain the shaft in the opening 212A while allowing the roller 212 to roll around the shaft 213.

As can be further seen from FIG. 3B, the cleaner-bracket assembly 215 may include a cleaner 218 and a bracket 217. The cleaner 218 may be compression fit within the bracket 217 to allow for easy replacement of the cleaner 218, without necessitating removal or replacement of the bracket 217. The bracket 217 includes the opening 215A for accommodating a first protrusion 213B of shaft 213, and includes one or more secondary openings 215B for accommodating one or more secondary protrusions 213C of shaft 213. Positioning the secondary protrusions 213C into the secondary openings 215B ensures that the shaft 213 will not rotate relative to the bracket 217.

Figure 3C:
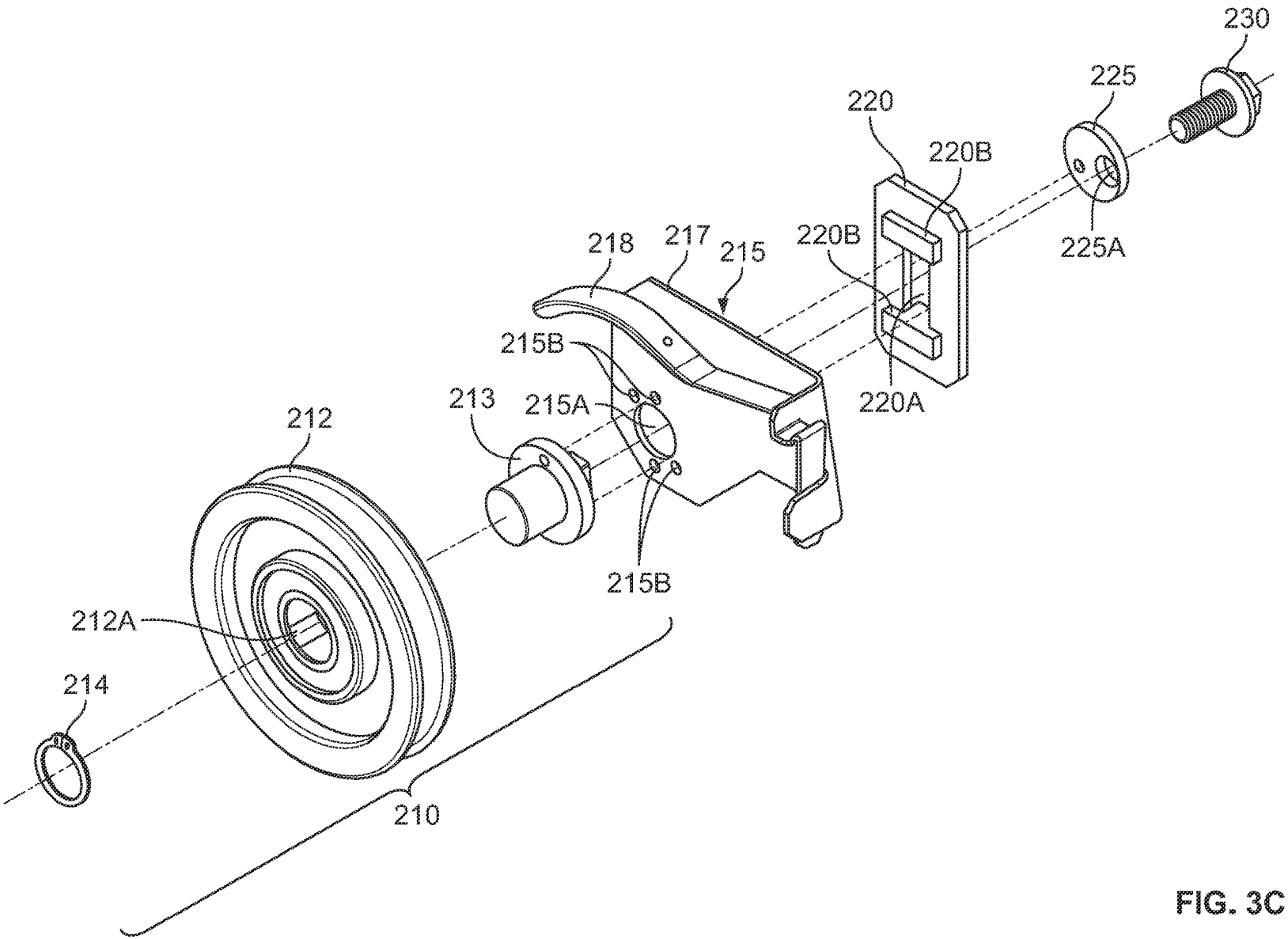
FIG. 3C is an exploded perspective view of the subsystem portion shown in FIG. 3B as seen from a second vantage point different from the first vantage point.

FIG. 3C is an exploded perspective view of the arrangement of FIG. 3B as seen from a vantage point different from that of FIG. 3B.

It should be noted with respect to the embodiment of FIGS. 3A-3C that the cleaner-bracket assembly 215 is typically formed from a multiple of parts, although it may be a single part. It should also be noted that the cleaner-bracket assembly 215 may include an integrated cleaner and oiler. Further, it should be noted that parts set 200 includes a cleaner-bracket assembly 230 that is different from cleaner-bracket assembly 215 in that cleaner-bracket assembly 230 is configured for use at one end of door hanger 80 while cleaner-bracket assembly 215 is configured for use at another end of door hanger 80 such that cleaner-bracket assembly 230 and cleaner-bracket assembly 215 may be said to mirror each other.

Other parts of the FIG. 3A embodiment include a support roller 235. The support roller 235 is provided to underlie the track (not shown) and guard against upward movements of the door 75 such that if the door is pushed in an upward direction (in direction A) the support roller 235 will be pushed against the underside of the track or track support (not shown) to prevent the roller assembly 210 from coming off of the track. The support roller 235 is mounted to the door hanger by bracket 237, bolts 245A and 245B, nuts 250A and 250B, and washers 255A and 255B. As can be seen form the figure, the bracket 237 includes two openings 237A and 237B, with opening 237B being sized to allow some pivotal movement of the bracket 237 about bolt 245A when bolts 245A and 245B are partially tightened into nuts 250A and 250B. This allows for adjustment of the support roller 235 in an up-down direction.

In addition, the FIG. 3A embodiment includes a retainer 240. The retainer 240 is secured to the door hanger by a bolt 260, nut 265, and washer 270. The retainer 240 provides backup support for the door 75 in the event the roller assembly 210, or an associated element, fails. That is, in the event of a failure, the retainer 240 may bear on the track to support the door 75. For example, if the roller 212 melts off in a fire, the retainer 240 maintains the general position of the door 75 by bearing on the track.

The parts sets 200 and 205 of FIG. 3A may be provided together to efficiently supply elevator service personnel with all the parts needed to replace two roller assemblies of a prior elevator door arrangement as shown in FIGS. 2A-2C. Also, the two parts sets 200 and 205 may be provided with a track to replace track 90 of the FIG. 2A-2C arrangement so that service personnel will have all the parts needed to replace the roller assemblies and track of the FIGS. 2A-2C arrangement. In some embodiments the two parts sets 200 and 205 may each include a nylon roller and the sets may be provided together with a steel track. Additionally, the part sets 200 and 205 may be provided separate from each other and separate from the track.

Figure 4:
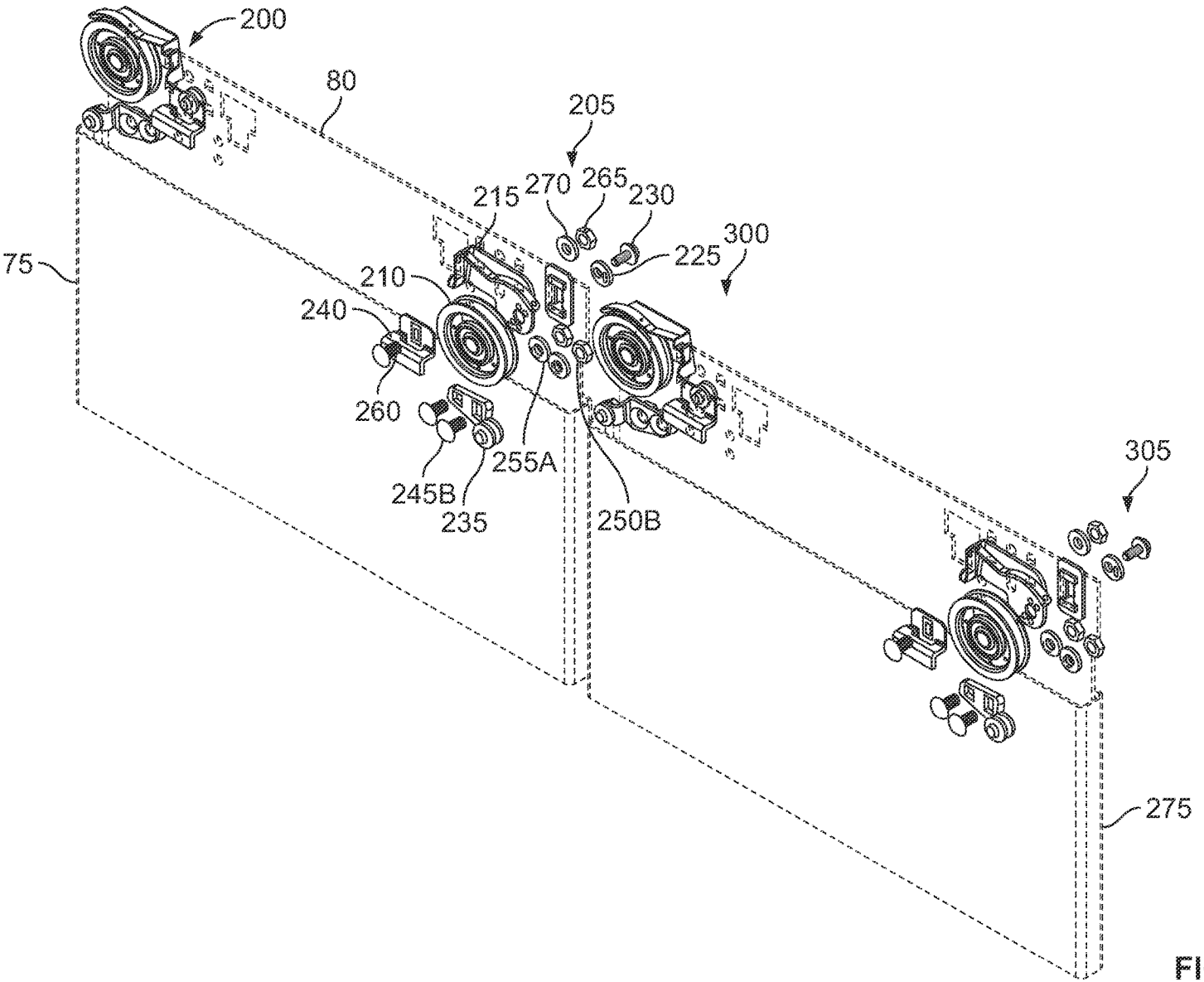
FIG. 4 is an isometric partially-exploded view of two elevator door subsystems, and respective elevator doors, according to an embodiment.

Referring now to FIG. 4, there is shown an isometric partially-exploded view of two elevator door subsystems, and respective elevator doors, according to an embodiment. The two doors may act together to close off an elevator hoistway or elevator car. The arrangement shown in FIG. 4 includes door 75 and parts sets 200 and 205 of FIG. 3, a second door 275, and parts sets 300 and 305. The second door 275 may be the same as door 75. The parts set 300 may be the same as parts set 200, and the parts set 305 may be the same as parts set 205. In some embodiments, such as when cleaner-bracket assemblies are excluded from the parts sets 200, 205, 300, and 305, parts sets 200, 205, 300, and 305 may be the same. Alternatively, one or more of parts sets 200, 205, 300, and 305 may differ from one or more of the other parts sets of parts sets 200, 205, 300, and 305. Also, doors 75 and 275 may differ from each other.

The parts sets 200, 205, 300, and 305 may be provided together to efficiently supply elevator service personnel with all the parts needed to replace roller assemblies for two doors of a prior elevator door arrangement. For example, the parts sets 200, 205, 300, and 305 may be provided to replace roller assemblies for a two door arrangement in which each door is configured like the door shown in FIGS. 2A-2C. Also, the parts sets 200, 205, 300, and 305 may be provided with one or more tracks to replace the corresponding track or tracks of the prior elevator door arrangement so that service personnel will have all the parts needed to replace the roller assemblies and track, or tracks, of a prior elevator door arrangement. For example, the parts sets 200, 205, 300, and 305 and two tracks may be provided to replace roller assemblies and tracks for a two door arrangement in which each door and track is configured like the door and track shown in FIGS. 2A-2C. Nevertheless, it should be noted that the two elevator door arrangement of FIG. 4 may be used with a single track on which the rollers of parts sets 200, 205, 300, and 305 roll, rather than with two tracks, one for the rollers of parts sets 200 and 205 and one for the rollers of parts sets 300 and 305. To address the one track case the parts sets 200, 205, 300, and 305 may be provided together with a single track. In any event, the parts sets 200, 205, 300, and 305 may each include a nylon roller and the sets may be provided together with one or more steel tracks. Additionally, the part sets 200, 205, 300, and 305 may be provided separate from each other and separate from the track or tracks.

Figure 5B:
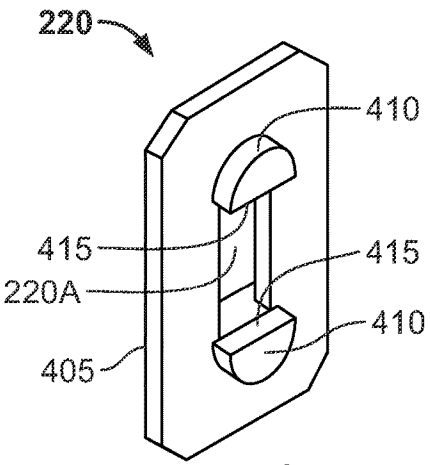
FIG. 5B is an isometric view of the hanger mount of FIG. 5A.
Figure 5A:
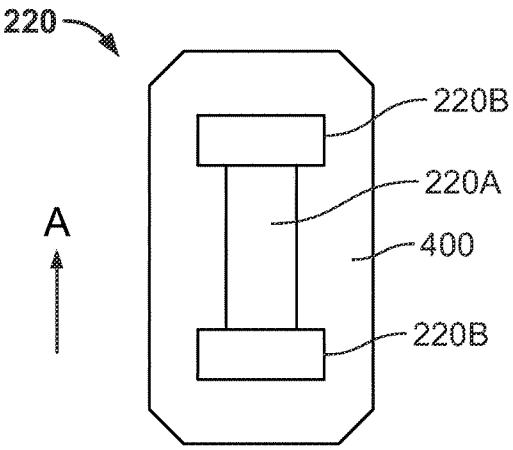
FIG. 5A is a side view of a hanger mount according to an embodiment.

Referring now to FIG. 5A, there is shown a side view of hanger mount 220 according to an embodiment. As can be seen from the figure, the hanger mount 220 has a first side 400 that includes rectangular protrusions 220B. The rectangular protrusions may be used for insertion into opening 80A of the door hanger 80. However, it should be noted that the present technology is not limited to a hanger mount having a first side with two rectangular protrusions. For example, the technology may employ a hanger mount having a single protrusion for insertion in the opening of a door hanger.

FIG. 5B is an isometric view of hanger mount 220. As can be seen from FIG. 5B, the hanger mount 220 has a second side 405 that includes two bearing protrusions 410. Each of the bearing protrusions 410 includes a bearing surface 415. The bearing surface 415 of each protrusion 410 is configured for sliding contact with a surface of the leveling cam 225. When the hanger mount 220 is positioned between the leveling cam 225 and roller assembly 210 by bolt 230, as shown for example in FIGS. 3A-3C, rotating the leveling cam 225 about bolt 230 while maintaining contact between the leveling cam 225 and one of the bearing surfaces 415 results in movement of the roller assembly 210 and bolt 230 along direction A, or opposite direction A, relative to the hanger mount 220, door hanger 80, and door 75. Thus, the bearing protrusions act in combination with the leveling cam 225 and bolt 230 to provide individual height adjustment of roller assemblies, such as roller assembly 210, according to the needs of a service job.

It should be noted that while the embodiment of FIG. 5B shows two bearing protrusions 410 and two bearing surfaces 415, the present technology is not restricted to such configuration. For example, the technology may employ a hanger mount having a single protrusion with a single bearing surface.

Figure 5C:
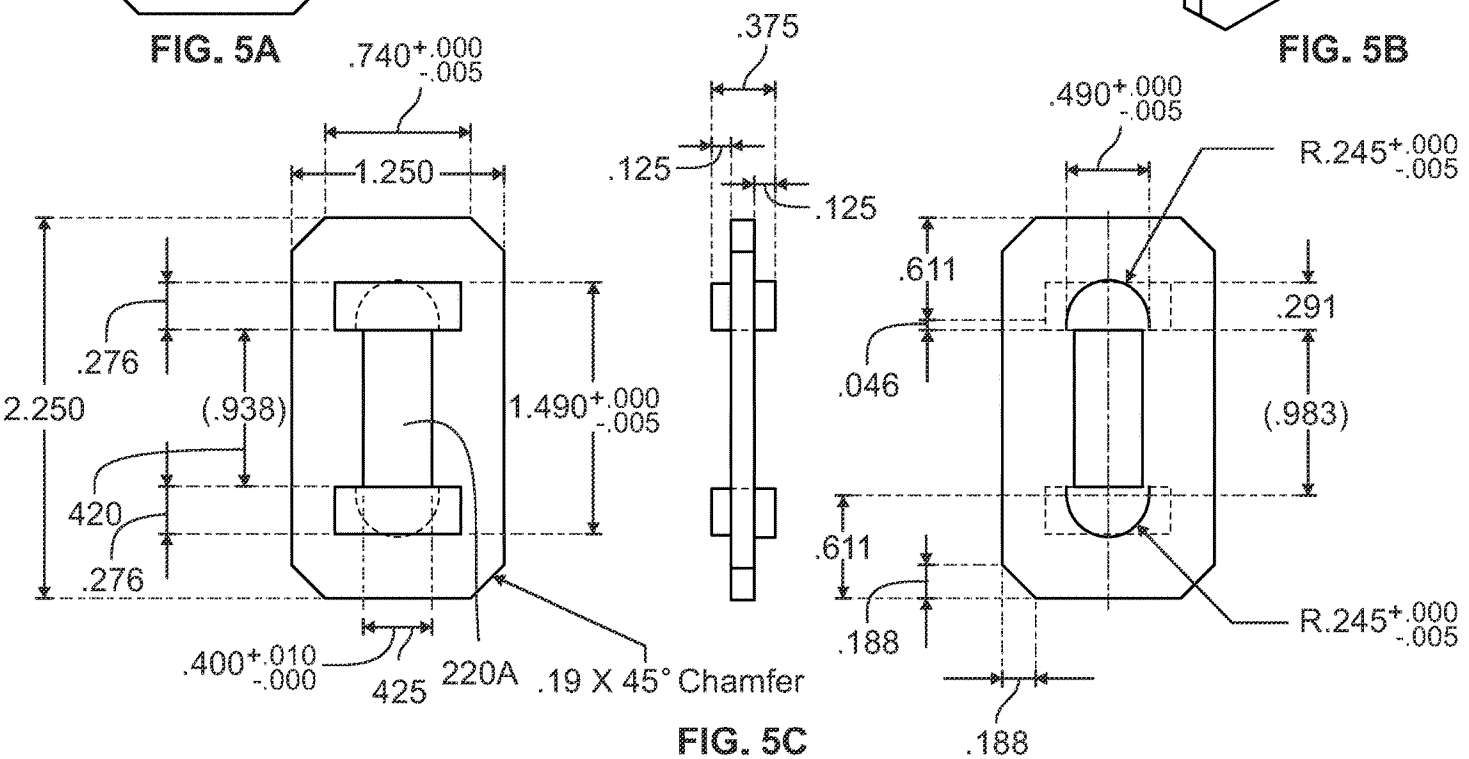
FIG. 5C shows a series of views of the hanger mount of FIGS. 5A and 5B showing one possible set of dimensions for the hanger mount.

Referring now to FIG. 5C, there is shown a series of views showing one possible set of dimensions for the hanger mount 220 of FIGS. 5A and 5B. The dimensions are in inches. Among the dimensions for the hanger mount 220 are a first dimension 420 and a second dimension 425. The first dimension 420 is larger than a diameter of the bolt 230 so that when the bolt 230 and leveling cam 225 are used to adjust the position of roller assembly 210 the bolt 230 is free to move along the direction corresponding to the first dimension. The second dimension 425 is smaller than a diameter of the leveling cam 225 so that the leveling cam can be placed against the hanger mount 220 without passing through opening 220A of the hanger mount 220.

Figure 6:
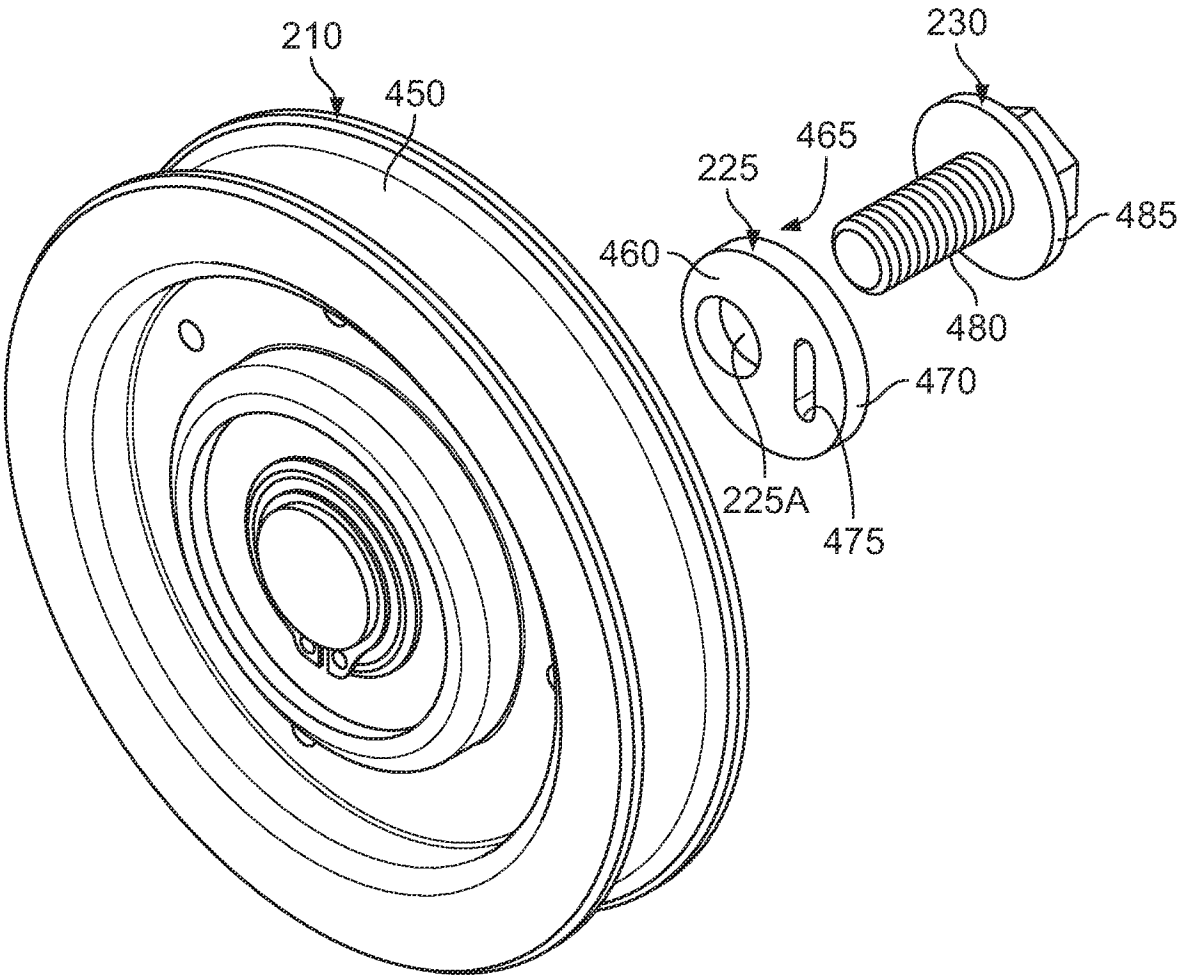
FIG. 6 is an isometric view of a roller assembly, leveling cam, and bolt of an elevator door subsystem according to an embodiment.

FIG. 6 is an isometric view of roller assembly 210, leveling cam 225, and bolt 230 of an elevator door subsystem according to an embodiment. For instance, the elements of FIG. 6 may be employed in the configuration of FIGS. 3A-3C. As can be seen from FIG. 6, the roller assembly 210 may have a track contacting portion 450 with a convex, or substantially convex, cross-section for placement on a track, the shape of the cross-section functioning to maintain alignment between the roller assembly 210 and the track. The leveling cam 225 may include a first surface 460, a second surface 465, and a third surface 470. The first surface 460 may have a circular perimeter of a diameter that is greater than the second dimension 425 of the hanger mount 220, and the second surface 465 may have a circular perimeter of a diameter which is the same as the diameter of the first surface 460. The third surface 470 is configured for contacting bearing surfaces 415 of the hanger mount 220. The opening 225A of the leveling cam 225 may be circular and off-center with respect to the perimeter of the leveling cam 225 such that when the third surface 470 is in contact with a bearing surface 415 of the hanger mount 220, and the leveling cam is rotated about the center of the opening 225A, the center of the leveling cam 225 will move along a direction corresponding to the first dimension 420 of the hanger mount 220. In addition, the leveling cam 225 includes a catch 475, which may be in the form of an opening in the leveling cam 225, a recess in the leveling cam 225, or a projection on the leveling cam 225. The catch 475 is provided for ease of rotating the leveling cam 225 about the center of opening 225A. For example, the leveling cam 225 may be rotated using a screwdriver by placing the head of the screwdriver into the catch 475.

Regarding the leveling cam 225, it should be noted that it is not necessary for the first surface 460 or second surface 465 to have a circular perimeter. For example, the perimeter of the first surface 460 and second surface 465 may have an elliptical shape.

Regarding the hanger mount 220, it should be noted that the hanger mount 220 is a multi-purpose component. In particular, the hanger mount 220 may be fit into the door hanger opening 80A as shown in FIGS. 3A-3C, by facing the first side 400 of the hanger mount 220 to the door hanger 80 and inserting protrusions 220B into the opening 80A, or may be fit into an opening of a different type on a different door hanger by facing the second side 405 of the hanger mount 220 toward the different door hanger and inserting protrusions 410 into the different type of opening. In the case of inserting protrusions 410 into a door hanger opening, the protrusions 220B may provide the bearing surfaces against which the leveling cam 225 may operate. In addition, it should be noted that the hanger mount 220 is not limited to the configuration depicted in the figures. The first side 400 may include a protrusion or protrusions other than rectangular protrusions 220B, and the second side may include a protrusion or protrusions other than the semi-circular protrusions 410. In any case, the protrusions included on a hanger mount of the present technology may be selected to fit into an opening on one or more types of vintage door hangers.

As further seen from FIG. 6, bolt 230 includes a threaded portion 480 and a flange 485. The threaded portion has a circular diameter that is smaller, or substantially equal to, the diameter of the leveling cam opening 225A so that the threaded portion 480 can pass through the opening 225A and be received in a blind hole (not shown) in the roller assembly 210, e.g., in opening 213A of shaft 213 (see FIG. 3B). The blind hole includes a threaded portion corresponding to the threaded portion 480 of the bolt 230 so that the bolt 230 can be secured to the roller assembly 210. The flange 485 is configured for urging the leveling cam 225 against the hanger mount 220 when the threaded portion 480 of the bolt 230 is engaged with the threaded portion of the roller assembly 210.

Figure 7A:
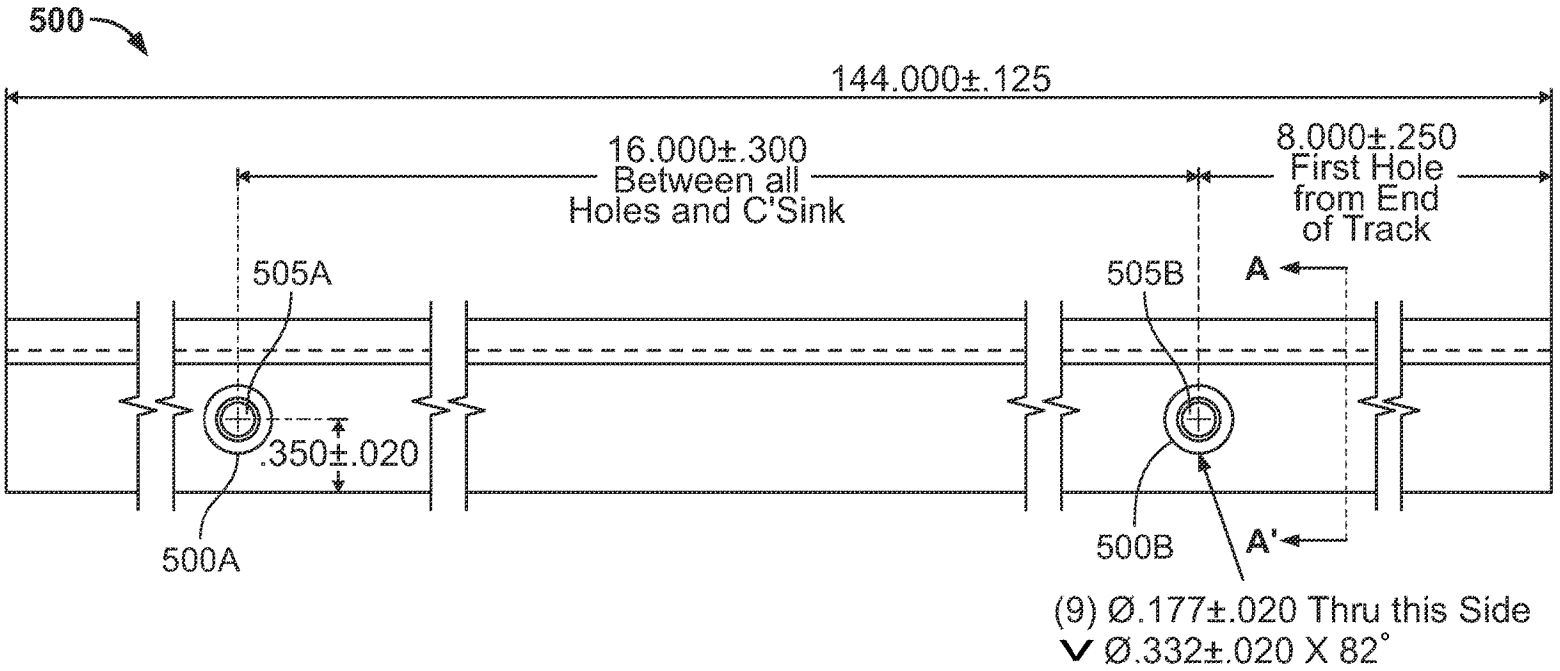
FIGS. 7A and 7B are a side view and a cross-section of a track according to an embodiment.
Figure 7B:
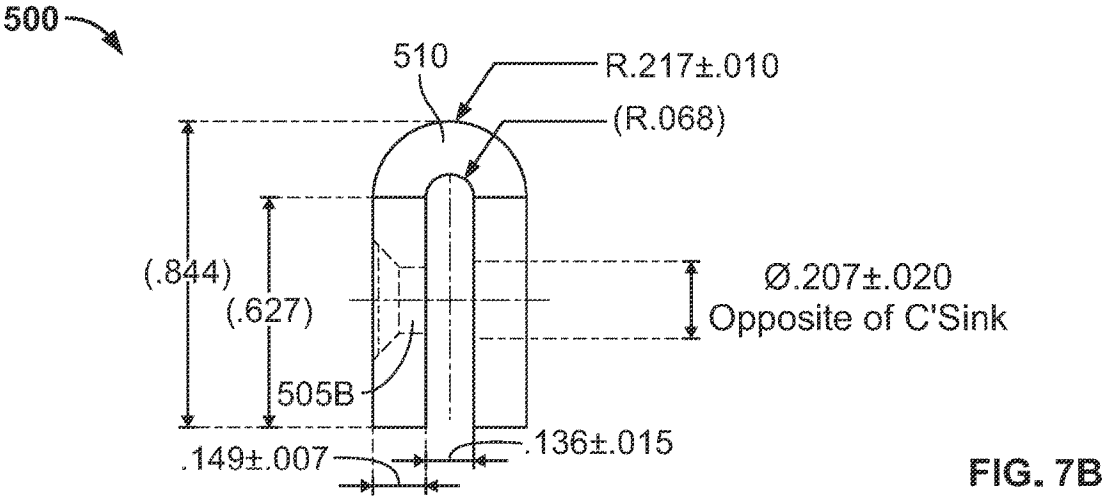

Referring now to FIGS. 7A and 7B, there are shown a side view and cross-section of a track 500 according to an embodiment. Illustrative dimensions for the track are shown in the figures and are in units of inches. The track 500 may be used to replace, for example, the track 90 shown in FIGS. 2A and 2C. Further, the track 500 may be made of steel. As can be seen from FIG. 7A, the track 500 includes two mounting holes 500A and 500B for accepting screws 505A and 505B which may be countersunk into the track 500 and used to mount the track 500 to a track support, such as an existing track support associated with header 85 of FIG. 2A. Notably, the track 500 is not limited to the two mounting holes 500A and 500B. In some embodiments more than two mounting holes may be provided. Moreover, in some embodiments a multiple of mounting holes may be provided such that subsets of the mounting holes correspond to respective types of track supports.

FIG. 7B is a cross-section of track 500 taken along axis AA'. As can be seen from FIG. 7B, the track 500 is shaped like an upside down "U" and has a roller contacting portion 510. The roller contacting portion 510 has a concave, or substantially concave, cross-section to compliment the convex, or substantially convex, cross-section of track contacting portion 450 of the roller assembly 210.

Embodiments of the present technology include, but are not restricted to, the following.

(1) An elevator door subsystem including a hanger mount having a first side, a second side, and an opening between the first side and second side, the first side having at least a portion configured for arrangement in an opening of an elevator door hanger, and the second side having at least a bearing surface; a leveling cam configured for sliding contact with the bearing surface and having a first surface, a second surface, an opening between the first surface and the second surface, and a third surface for contacting the bearing surface; an engaging member configured for placement in the opening of the hanger mount and the opening of the leveling cam; and a roller assembly for receiving the engaging member, such that when the roller assembly is positioned on one side of the elevator door hanger, the hanger mount is positioned within the opening of the elevator door hanger, and the leveling cam is positioned on another side of the elevator door hanger, the engaging member is receivable by the roller assembly after the engaging member is passed through the opening in the leveling cam, the opening in the hanger mount, and the opening in the door hanger.

(2) The elevator door subsystem of (1), wherein the system is operable such that when the roller assembly is positioned on one side of the elevator door hanger, the hanger mount is positioned within the opening of the elevator door hanger, the leveling cam is positioned on another side of the elevator door hanger, and the engaging member is received by the roller assembly after the engaging member is passed through the opening in the leveling cam, the opening in the hanger mount, and the opening in the door hanger, the position of the roller assembly is adjustable by rotating the leveling cam about the engaging member.

(3) The elevator door subsystem of (1), further including a track configured to receive a roller of the roller assembly so that the roller is operable to roll along the track.

(4) The elevator door subsystem of (3), wherein the track includes steel.

(5) The elevator door subsystem of (1), wherein the roller assembly includes a nylon roller.

(6) The elevator door subsystem of (1), further including a second hanger mount, a second leveling cam, a second engaging member and a second roller assembly.

(7) The elevator door subsystem of (6), further including a track configured to receive a roller of the roller assembly and a second roller of the second roller assembly so that the roller and the second roller are operable to roll along the track at the same time.

(8) The elevator door subsystem of (1), wherein the engaging member includes a bolt having a threaded portion and a flange, the threaded portion configured to be received by a corresponding threaded portion of the roller assembly, and the flange configured for urging the leveling cam against the hanger mount when the threaded portion of the bolt is engaged with the corresponding threaded portion of the roller assembly.

(9) The elevator door subsystem of (8), wherein the threaded portion of the roller assembly is included in a shaft of the roller assembly.

(10) The elevator door subsystem of (1), wherein the leveling cam includes a catch usable for rotating the leveling cam when the engaging member is positioned in the opening in the leveling cam.

(11) The elevator door subsystem of (1), further including a cleaner-bracket assembly configured for mounting on the elevator door hanger and cleaning a roller of the roller assembly.

(12) The elevator door subsystem of (1), further including a support roller configured for mounting on the elevator door hanger and maintaining a position of the elevator door hanger relative to a track that receives a roller of the roller assembly.

(13) A method for replacing parts of an elevator door assembly including removing rollers from an elevator door hanger of the door assembly; installing a hanger mount in an opening of the elevator door hanger, the hanger mount having a first side, a second side, and an opening between the first side and second side, the first side having at least a portion configured for arrangement in the opening of the elevator door hanger, and the second side having at least a bearing surface; positioning a roller assembly on one side of the elevator door hanger, the roller assembly being configured to receive an engaging member; positioning a leveling cam on another side of the elevator door hanger, the leveling cam configured for sliding contact with the bearing surface and having a first surface, a second surface, an opening between the first surface and the second surface, and a third surface for contacting the bearing surface; and inserting the engaging member through opening of the hanger mount and the opening of the leveling cam, and securing the engaging member within the roller assembly.

(14) The method of (13), further including adjusting a position of the roller assembly by rotating the leveling cam about the engaging member.

(15) The method of (13), further including providing a track configured to receive a roller of the roller assembly so that the roller is operable to roll along the track.

(16) The method of (15), wherein the track includes steel.

(17) The method of (13), wherein the roller assembly includes a nylon roller.

(18) The method of (13), further including mounting a cleaner-bracket assembly on the elevator door hanger such that a cleaner of the cleaner-bracket assembly acts to clean a roller of the roller assembly.

(19) The method of (13), further including mounting a support roller on the elevator door hanger such that the support roller maintains a position of the elevator door hanger relative to a track that receives a roller of the roller assembly.

(20) A kit for replacing parts of an elevator door assembly including a hanger mount having a first side, a second side, and an opening between the first side and second side, the first side having at least a portion configured for arrangement in an opening of an elevator door hanger, and the second side having at least a bearing surface; a leveling cam configured for sliding contact with the bearing surface and having a first surface, a second surface, an opening between the first surface and the second surface, and a third surface for contacting the bearing surface; an engaging member configured for placement in the opening of the hanger mount and the opening of the leveling cam; and a roller assembly for receiving the engaging member, such that when the roller assembly is positioned on one side of the elevator door hanger, the hanger mount is positioned within the opening of the elevator door hanger, and the leveling cam is positioned on another side of the elevator door hanger, the engaging member is receivable by the roller assembly after the engaging member is passed through the opening in the leveling cam, the opening in the hanger mount, and the opening in the door hanger.

Most of the foregoing alternative examples are not mutually exclusive and may be implemented in various combinations to achieve unique advantages. As these and other variations and combinations of the features discussed above may be utilized without departing from the subject matter defined by the claims, the foregoing description of the embodiments should be taken by way of illustration rather than by way of limitation of the subject matter defined by the claims. As an example, the preceding operations do not have to be performed in the precise order described above. Rather, various steps can be handled in a different order, such as reversed, or simultaneously. Steps can also be omitted unless otherwise stated. In addition, the provision of the examples described herein, as well as clauses phrased as "such as," "including" and the like, should not be interpreted as limiting the subject matter of the claims to the specific examples; rather, the examples are intended to illustrate only one of many possible embodiments. Further, the same reference numbers in different drawings may identify the same or similar elements.

Although the present disclosure herein has been described with reference to particular embodiments, it is to be understood that these embodiments are merely illustrative of the principles and applications of the present disclosure. It is therefore to be understood that numerous modifications may be made to the illustrative embodiments and that other arrangements may be devised without departing from the spirit and scope of the present disclosure as defined by the appended claims.

The invention claimed is:

1. A method for replacing parts of an elevator door assembly comprising:

removing rollers from an elevator door hanger of the door assembly;

installing a hanger mount in an opening of the elevator door hanger, the hanger mount having a first side, a second side, and an opening between the first side and second side, the first side having at least a portion configured for arrangement in the opening of the elevator door hanger, and the second side having at least a bearing surface;

positioning a roller assembly on one side of the elevator door hanger, the roller assembly being configured to receive an engaging member;

positioning a leveling cam on another side of the elevator door hanger, the leveling cam configured for sliding contact with the bearing surface and having a first surface, a second surface, an opening between the first surface and the second surface, and a third surface for contacting the bearing surface; and inserting the engaging member through the opening of the hanger mount and the opening of the leveling cam, and securing the engaging member within the roller assembly.

2. The method of claim 1, further comprising adjusting a position of the roller assembly by rotating the leveling cam about the engaging member.

3. The method of claim 1, further comprising providing a track configured to receive a roller of the roller assembly so that the roller is operable to roll along the track.

4. The method of claim 3, wherein the track comprises steel.

5. The method of claim 1, wherein the roller assembly comprises a nylon roller.

6. The method of claim 1, further comprising mounting a cleaner-bracket assembly on the elevator door hanger such that a cleaner of the cleaner-bracket assembly acts to clean a roller of the roller assembly.

7. The method of claim 1, further comprising mounting a support roller on the elevator door hanger such that the support roller maintains a position of the elevator door hanger relative to a track that receives a roller of the roller assembly.

* * * * *